US005351701A

United States Patent [19]

Hsiao

[11] Patent Number: 5,351,701

[45] Date of Patent: Oct. 4, 1994

[54] CRUTCH STRUCTURE

[76] Inventor: Fang-jung Hsiao, 380-8, Hsinchuotze, Lung-Chiang Li, Pu Tai, Chiayi Hsien, Taiwan

[21] Appl. No.: 216,831

[22] Filed: Mar. 24, 1994

[51] Int. Cl.[5] ..... A61H 3/02

[52] U.S. Cl. ..... 135/68; 135/69; 135/72; 135/75

[58] Field of Search ..... 135/65, 68, 69, 71, 135/72, 73, 75, 114; 248/188.5

[56] References Cited

U.S. PATENT DOCUMENTS

| | | | |
|---|---|---|---|
| 127,028 | 5/1872 | Crandall | 135/72 |
| 904,481 | 11/1908 | Hood | 135/72 X |
| 1,296,728 | 3/1919 | Yates | 135/72 |
| 3,730,198 | 5/1973 | Johnston et al. | 135/73 X |
| 4,476,885 | 10/1984 | Stein | 135/72 X |
| 4,637,414 | 1/1987 | Urban | 135/73 |
| 4,865,065 | 9/1989 | Chen | 135/68 X |
| 4,869,280 | 9/1989 | Ewing | 135/71 X |
| 4,979,533 | 12/1990 | Hansen et al. | 135/72 X |
| 5,197,502 | 3/1993 | Wang | 135/68 X |

*Primary Examiner*—Lanna Mai

*Attorney, Agent, or Firm*—Browdy and Neimark

[57] ABSTRACT

A crutch structure including an armpit seat, a lateral tube assembly having two lateral tubes, a handle assembly, a middle supporting tube, a bottom cap and a telescopic tube. The lateral tubes are symmetrically arranged, each including an outer semi-circular tube section and an inner rectangular beam section. Multiple aligned pairs of transverse through holes are formed on predetermined portions of the lateral tubes. Lower portions of the lateral tubes first extending downward and toward each other and then extending straight downward in parallel with each other. The handle assembly is adjustably locked on the lateral tubes. The middle supporting tube includes a central circular tube section having multiple aligned pairs of circular through holes formed on front and back sides of the circular tube section, and two lateral substantially C-shaped outward open rib sections corresponding to the rectangular beam sections of the lateral tubes. The C-shaped rib sections of the supporting tube are engaged with rectangular beam sections of the lateral tubes the telescopic tube is adjustably fitted into the supporting tube at a height according to the height of a user.

4 Claims, 7 Drawing Sheets

31a
3a
31a
32a 31a
32a
31a
21
33
21
72
7
712
71
711
21
2
32
31
31
3
33
22
22
4

43
41
4
5
621
6
61
64
611
61
631
63
621
62

CRUTCH STRUCTURE

BACKGROUND OF THE INVENTION

The present invention relates to an improved crutch structure.

As shown in FIG. 1, a conventional crutch structure is mainly composed of an armpit seat 11, lateral tubes 12, handle 13, middle supporting tube 14, bottom cap 15 and telescopic tube 16. FIG. 3 shows the cross-section of the engaged supporting tube 14 and lateral tubes 12, wherein the supporting tube 14 has a central circular tube section 143 and two lateral outward projecting sections 142. Each projecting section 142 has a concave arch top surface suitable to snugly abut against and engage with the lateral tube 12 by means of rivets. As shown in FIG. 2, the supporting tube 14 is inserted into the bottom cap 15, while the lateral tubes 12 are not fitted thereinto and the lower ends of the lateral tubes 12 are plugged by end plugs 122. As shown in FIG. 5, a resilient fixing leaf member 161 is disposed inside a top end of the telescopic tube 16. The leaf member 161 has two free ends disposed with outward projecting bosses 1611 which extend through one of multiple pairs of fixing holes 141 formed on the supporting tube 14 so that the telescopic tube 16 can be adjustably telescopically fitted through the bottom cap 15 and inside the supporting tube 14. The outer diameter of the telescopic tube 16 matches with the diameter of a central through hole of the bottom cap 15, allowing the telescopic tube 16 to snugly and freely slide relative to the bottom cap 15. The inner diameter of the supporting tube 14 is slightly larger than the outer diameter of the telescopic tube 16 so as to avoid abrasion between the telescopic tube 16 and the supporting tube 14. In addition, referring to FIG. 4, the handle 13 has a shaft member 131 having two arch end surfaces suitable to snugly abut against the lateral tubes 12. The shaft member 131 is sleeved by a sponge sleeve 132 and formed with a central through hole, whereby the shaft member 131 can be clamped between the lateral tubes 12 and an elongated thread rod 133 can be extended through the central through hole of the shaft member 131 to secure with a butterfly nut 134 so as to lock the handle 13 on the lateral tubes 12.

Several shortcomings exist in the above conventional crutch structure as follows:

1. The lateral tubes 12 are engaged with the supporting tube 14 in such a manner that the lateral tubes 12 are first attached to the arch surfaces of the projecting sections 142 and then fixed thereon by means of rivets. Accordingly, in case a large force is exerted on the crutch in a normal direction for a period of time, the crutch is liable to deform and bend at the rivet position A as shown in FIG. 6. Therefore, the safety in use of the crutch cannot be insured.

2. In case the crutch is 45 degrees inclinedly placed relative to the ground and the armpit of a user is supported by the armpit seat 11, when a large force is suddenly exerted on the handle 13, the crutch is apt to deform and bend or even break at the fixing hole position S of the lateral tube 12 due to decreased strength, as shown in FIG. 7.

3. The supporting tube 14 is inserted into the bottom cap 15 while the lateral tubes 12 are not fitted thereinto and are plugged by the plug members 122. Therefore, the waste chips produced during processing or accumulated water D is unable to be exhausted from the lateral tubes 12. As a result, the inner walls of the lateral tubes 12 is liable to be corroded by the accumulated water and the quality and safety in use of the crutch cannot be insured, as shown in FIG. 2.

4. The inner diameter of the supporting tube 14 is slightly larger than the outer diameter of the telescopic tube 16 so that a clearance is formed therebetween and the telescopic tube 16 is unable to closely attach to the inner wall of the supporting tube 14. As a result, when using the crutch, an unstable slightly vibrating feeling Q will occur, as shown in FIG. 2.

SUMMARY OF THE INVENTION

It is a primary object of the present invention to provide an improved crutch structure wherein after the handle assembly is secured on the lateral tubes, upper and lower ends of two lateral sleeve members of the handle assembly are located at a position away from the through holes of the lateral tubes so that the sleeve members can not only reinforce the through hole portions of the lateral tubes but also distribute the force to the non-through hole area of the lateral tubes so as to avoid breakage of the crutch.

It is a further object of the present invention to provide the above crutch structure, wherein a bushing member with upper stretching claws is fitted in a top end of the telescopic tube, whereby after the telescopic tube is inserted into the supporting tube, the stretching claws will abut against the inner wall of the supporting tube for stabilizing the telescopic tube.

It is still a further object of the present invention to provide the above crutch structure, wherein the lateral tubes are engaged with the supporting tube by means of rib sections and beam sections thereof so that the strength of the crutch against oblique force is greatly increased and the connection structure of the crutch is reinforced to insure the safety and durability of the crutch.

It is still a further object of the present invention to provide the above crutch structure, wherein after the lateral tubes are engaged with the supporting tube, the bottom ends of the three tubes are fitted with the bottom cap while not being sealed so that the remains can be easily exhausted without corroding the inner walls of the tubes.

The present invention can be best understood through the following description and accompanying drawings, wherein:

DETAILED DESCRIPTION OF THE PREFERRED EMBODIMENTS

Figure 1:
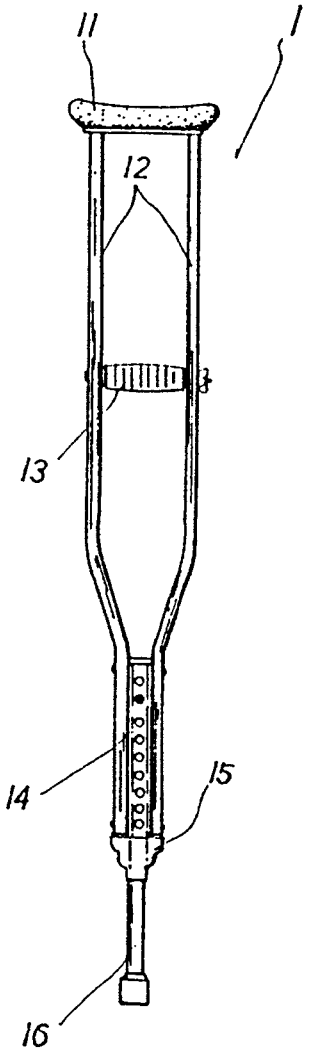
FIG. 1 PRIOR ART
FIG. 1 shows a conventional crutch.
Figure 2:
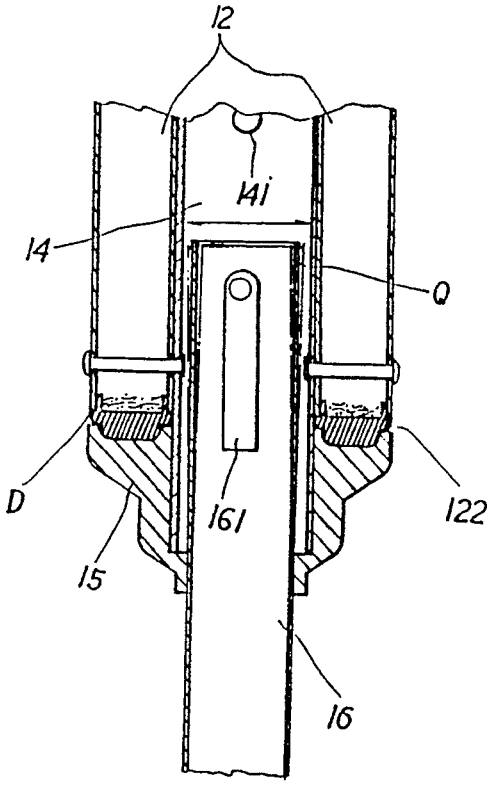
FIG. 2 PRIOR ART
FIG. 2 is a longitudinal sectional view showing the connection between the lateral tubes, middle supporting tube and telescopic tube-of the conventional crutch.
Figure 3:
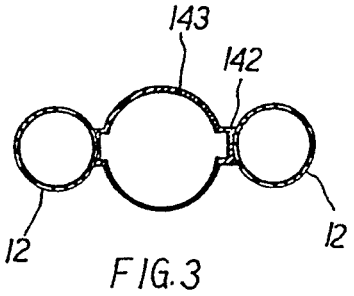
FIG. 3 PRIOR ART
FIG. 3 is a cross-sectional view showing the connection between the lateral tubes and middle supporting tube of the conventional crutch.
Figure 4:
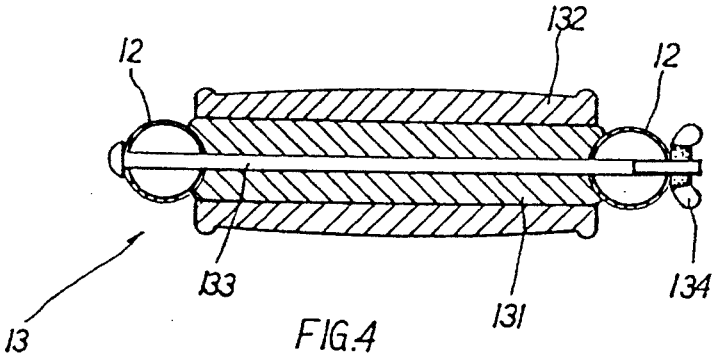
FIG. 4 PRIOR ART
FIG. 4 is a sectional view showing the connection between the lateral tubes and the handle of the conventional crutch.
Figure 7:
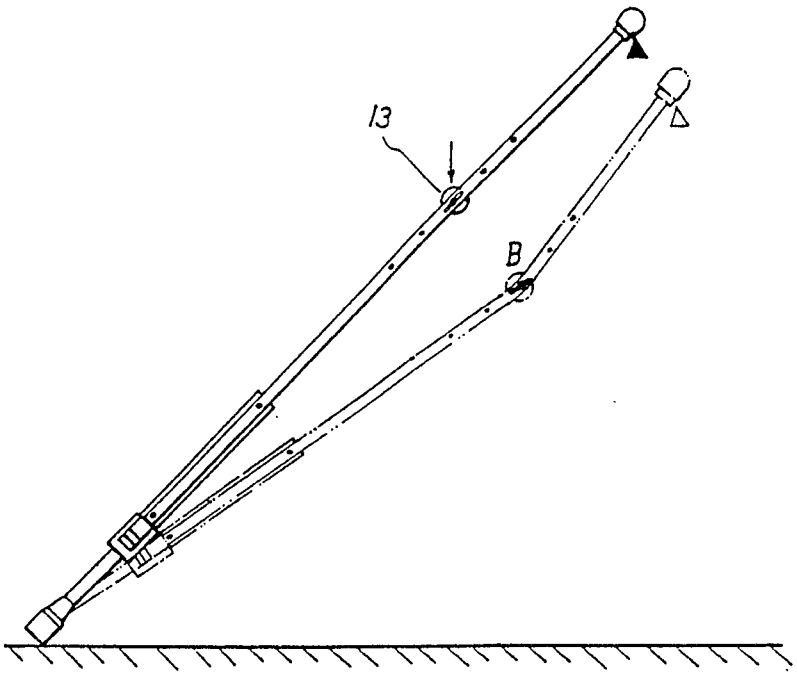
FIG.7 PRIOR ART
FIG. 7 shows that the conventional crutch is bent when suffering external force under another circumstance.
Figure 6:
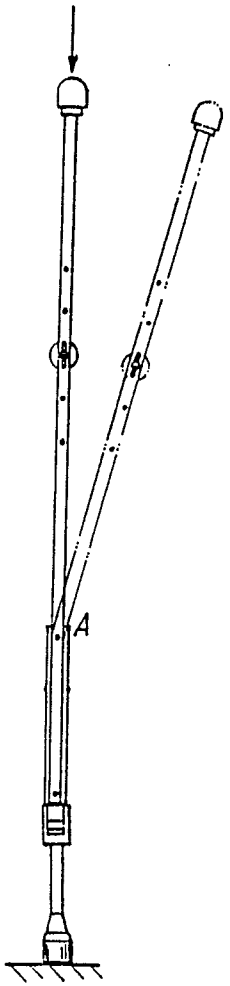
FIG.6 PRIOR ART
FIG. 6 shows that the conventional crutch is bent when suffering external force.
Figure 5:
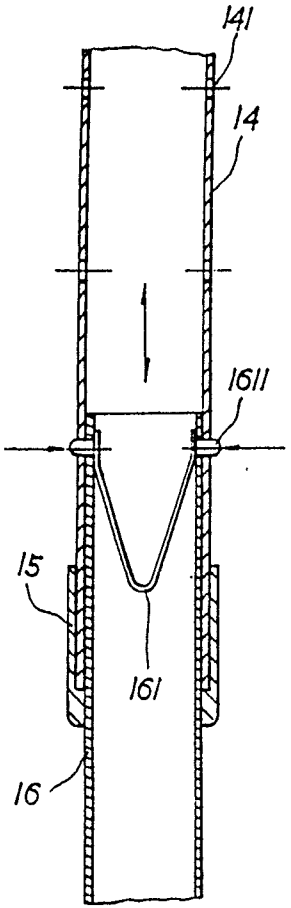
FIG.5 PRIOR ART
FIG. 5 is a sectional view showing the telescopic movement of the telescopic tube inside the middle supporting tube of the conventiona crutch.
Figures 8, 9, 15, 15A:
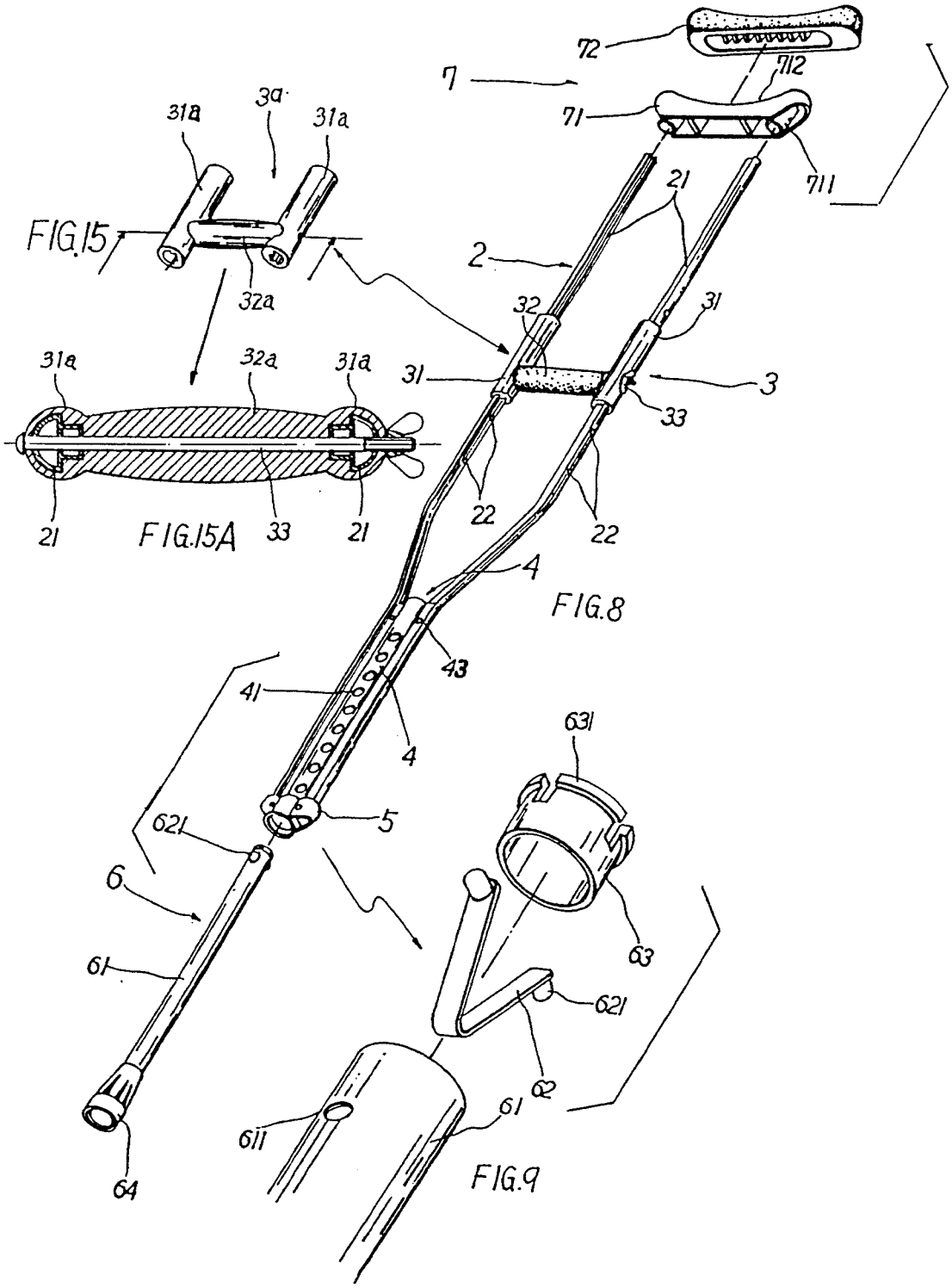
FIG. 8 is a perspective assembled view of the present invention.
FIG. 9 is a perspective exploded view of the telescopic tube of the present invention.
FIG. 15 is a perspective view of a second embodiment of the handle assembly of the present invention.
FIG. 15A is a sectional view according to FIG. 15.
Figure 10A:
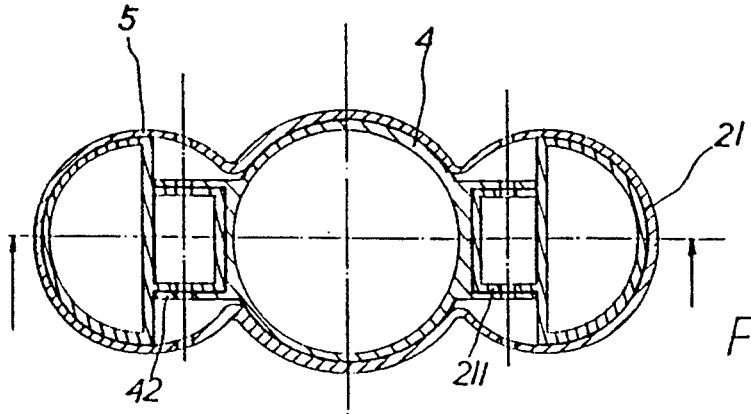
FIG. 10A is a cross-sectional view according to FIG. 10.
Figure 10:
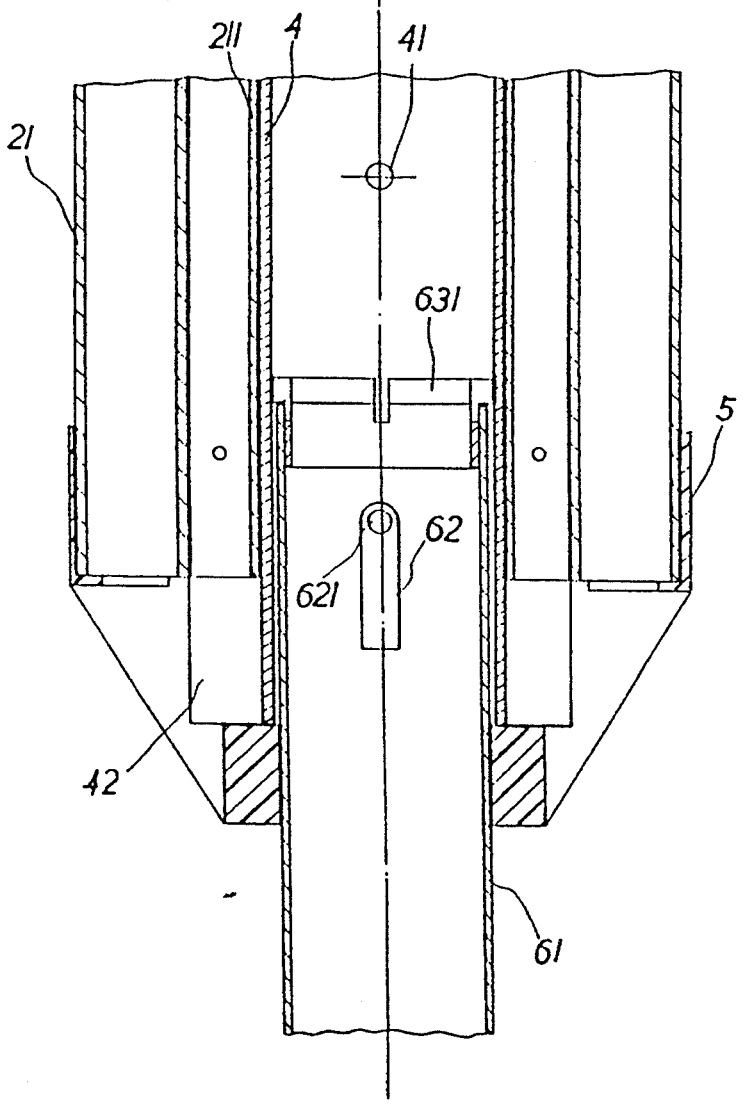
FIG. 10 is a longitudinal sectional view showing the connection between the lateral tubes, middle supporting tube and telescopic tube of the present invention.
Figure 11:
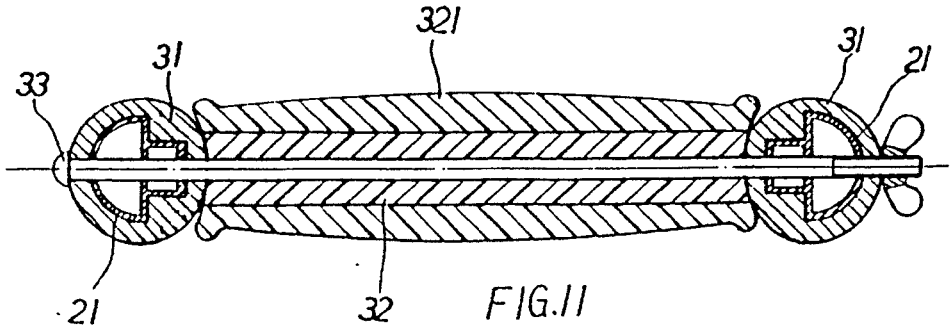
FIG. 11 is a sectional view showing the connection between the lateral tubes and the handle assembly of the present invention.
Figure 12:
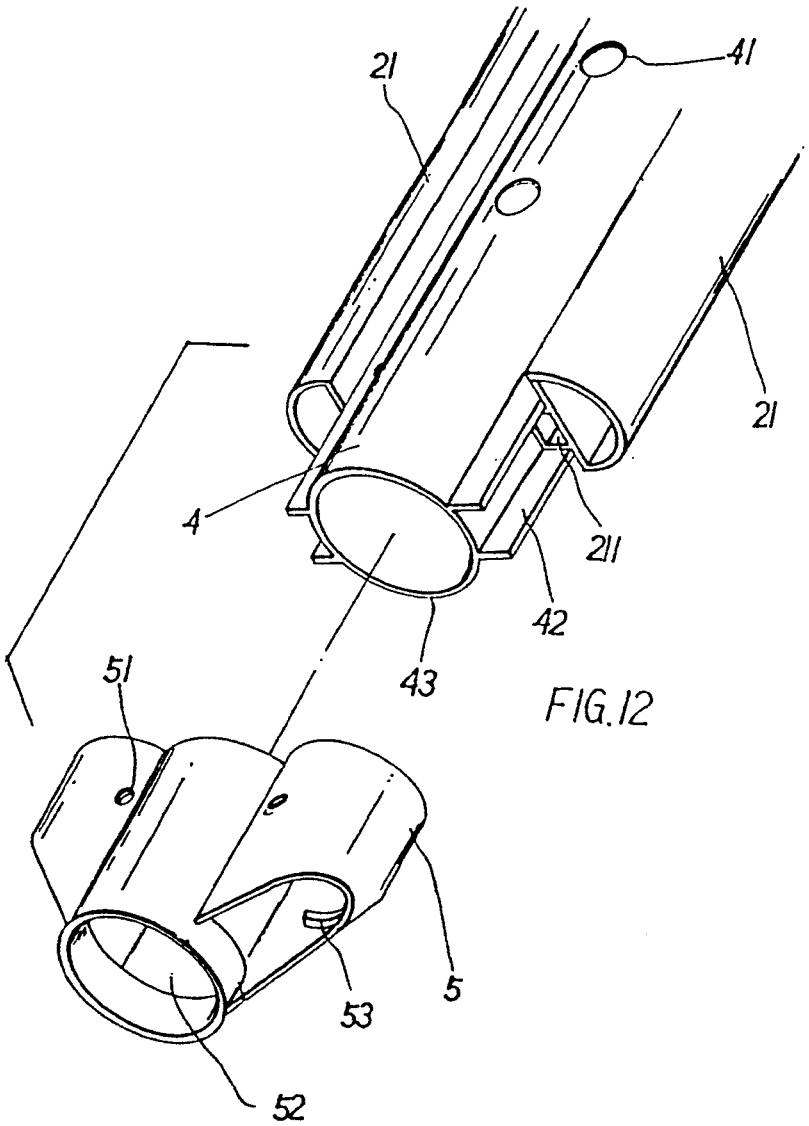
FIG. 12 is a perspective view of the lateral tubes, supporting tube and bottom cap of the present invention.

Please refer to FIG. 8. The crutch structure of the present invention mainly includes an armpit seat 7, a lateral tube assembly 2 having two lateral tubes 21, a handle assembly 3, a middle supporting tube 4, a bottom cap 5 and a telescopic tube 6, wherein:

the armpit seat 7 includes a saddle member 71 having an upper curved surface 712 and two lower sleeve sections 711 for receiving and fixedly connecting with the two lateral tubes 21, and a soft pad member 72 wrapping the saddle member 71 for making a user comfortable when using the crutch structure;

the lateral tubes 21 are symmetrically arranged, each lateral tube 21 including an outer semi-circular tube section and an inner rectangular beam section 211 (as shown in FIGS. 10 and 12), multiple aligned pairs of transverse through holes 22 being formed on predetermined portions of the two lateral tubes 21 for adjustably securing the handle assembly 3 thereon (as shown in FIG. 8), lower portions of the two lateral tubes 21 first extending downward and toward each other and then extending straight downward in parallel with each other;

the handle assembly 3 is substantially H-shaped, including two vertically arranged sleeve members 31 and a transverse handle member 32 wrapped by a soft sleeve 321 (as shown in FIG. 11), the handle assembly 3 being assembled with the lateral tubes 21 in such a manner that the two sleeve members 31 is first fitted on the lateral tubes 21 in alignment with a pair of through holes 22 thereof and then the handle 32 with the soft sleeve 321 is transversely disposed between two thread holes of the two sleeve members 31 and then an elongated thread rod 33 is extended through the through holes 22 of the lateral tubes 21, the thread holes of the sleeve members 31 and a central hole of the handle 32 to engage with a butterfly nut so as to lock the handle assembly 3 on the lateral tubes 21, the sleeve members 31 being such dimensioned that when locked on the lateral tubes 21, an upper and a lower end of each sleeve member 31 are located at positions spaced from the through holes 22 of the lateral tube 21 so that in case the crutch suffers an abnormal force in a large angle direction, the lateral tube 21 is able to bear the force transmitted from the upper and lower ends of the sleeve member 31 without deformation or bending;

the middle supporting tube 4 includes a central circular tube section 43 having multiple aligned pairs of circular through holes 41 formed on front and back sides of the circular section 43, and two lateral substantially C-shaped outward open rib sections 42 (as shown in FIGS. 10 and 12);

the bottom cap 5 is an integrally molded member, including a central sleeve section having a stepped central through hole 52 for abutting against and engaging with a lower end of the supporting tube 4, and two lateral substantially semi-circular tube sections having arch projections 53 for abutting against and engaging with the lateral tubes 21; and the telescopic tube 6 includes a circular tube member 61 formed with two upper symmetric circular holes 611, a V-shaped resilient member 62 disposed inside a top end of the circular tube member 61 in a compressed state, having two free ends each of which is formed with an outward projecting boss 621 resiliently inserted and fixed in the circular holes 611 of the circular tube member 61, and a bushing member 63 having stretching claws 631 and plugged into the top end of the circular tube member 61, a soft bottom pad 64 being fitted with a bottom end of the circular tube member 61.

According to the above arrangements, when assembled, the sleeve members 31 of the handle assembly 3 are first fitted on the lateral tubes 21 and then two upper ends of the lateral tubes 21 are inserted into the two sleeve sections 711 of the armpit seat 7 and riveted therewith. Thereafter, the C-shaped rib sections 42 of the supporting tube 4 are engaged with the rectangular beam sections 211 of the lateral tubes 21 and slided upward from bottom ends thereof to a predetermined position. Then the C-shaped rib sections 42 are secured with the rectangular beam sections 211 by rivets 43. Then the bottom cap 5 is fitted with and riveted with the bottom end of the engaged lateral tubes 21 and supporting tube 4. Thereafter, the telescopic tube 6 fitted into the supporting tube 4 with the bosses 621 of the V-shaped resilient member 62 compressed and inserted into a desired pair of through holes 41 of the supporting tube 4 so as to lock the telescopic tube 6 in the supporting tube 4. Finally, the handle 32 is adjustably secured between the sleeve members 31 and the handle assembly 3 is locked with the lateral tubes 21 at a height according to the length of the user' hand.

Please now refer to FIGS. 15 and 15A which show a second embodiment of the handle assembly of the present invention. The handle assembly 3*a* is an integrally molded H-shaped member, including two longitudinal tube sections 31*a* corresponding to the sleeve members 31 of the first embodiment of the handle assembly 3, and a transverse tube section 32*a* corresponding to the handle 32 thereof. A transverse central through hole is disposed through the transverse tube section 32*a* as well as the longitudinal tube sections 31*a* so that the elongated thread rod 33 can extended through the transverse through hole and desired through holes 22 of the lateral tubes 21 to be secured with a butterfly nut for locking the handle assembly 3*a* on the lateral tubes 21 as previously described.

Figure 13:
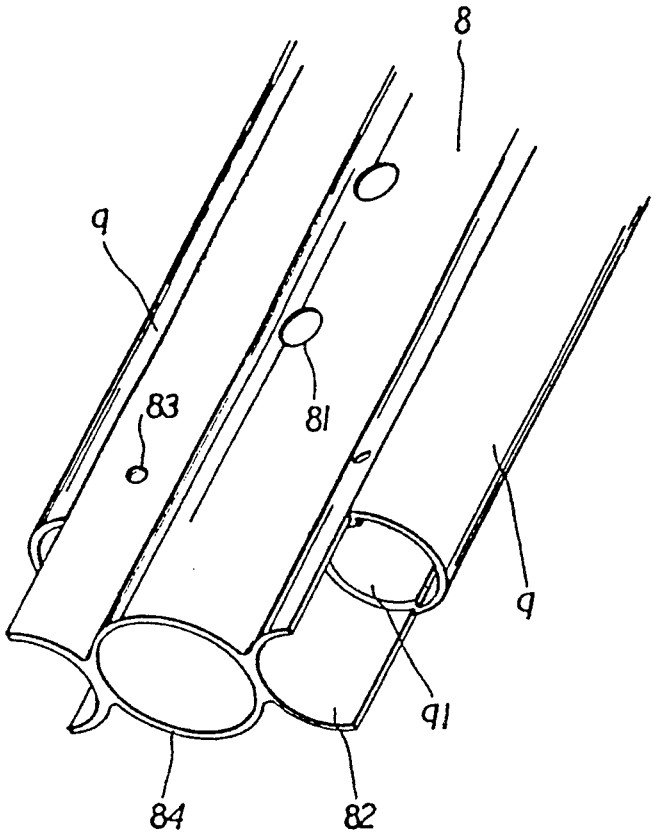
FIG. 13 is a perspective view of a second embodiment of the lateral tubes and supporting tube of the present invention.
Figure 13A:
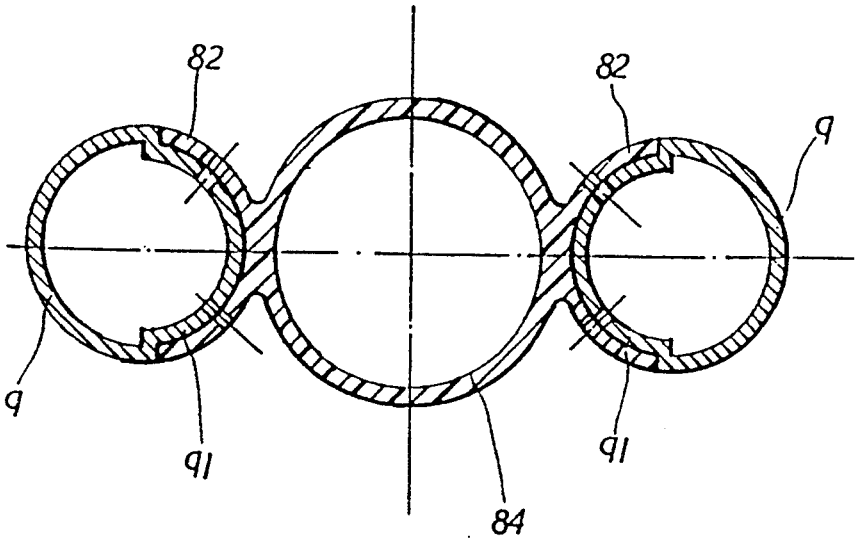
FIG. 13A is a cross-sectional view according to FIG. 13.

Please refer to FIGS. 13 and 13A which show a second embodiment of the lateral tubes and the supporting tube of the present invention, wherein each lateral tube 9 has an outer semi-circular section and an inner semi-circular section 91 with a diameter smaller than that of the outer semi-circular section. The supporting tube 8 has a central circular tube section 84 and two lateral concave semi-circular rib sections 82 corresponding to the inner semi-circular section 91 of the lateral tube 9.

When assembled, the supporting tube 8 is fitted with two lower ends of the lateral tubes 9 and slided upward therefrom to a predetermined portion of the lateral tubes 9. Then the bottom cap 5 is fitted with and riveted with the bottom end of the engaged supporting tube 8 and lateral tubes 9 as previously described.

Figure 14:
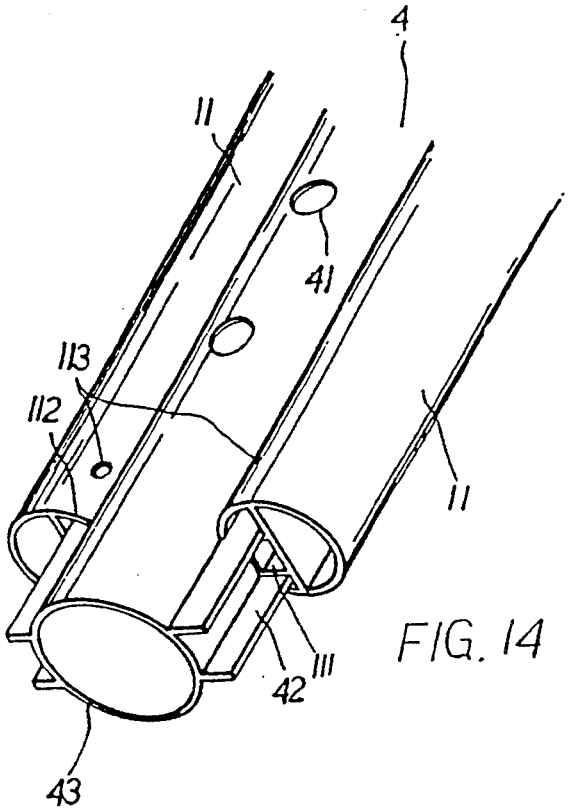
FIG. 14 is a perspective view of a third embodiment of the lateral tubes and supporting tube of the present invention.
Figure 14A:
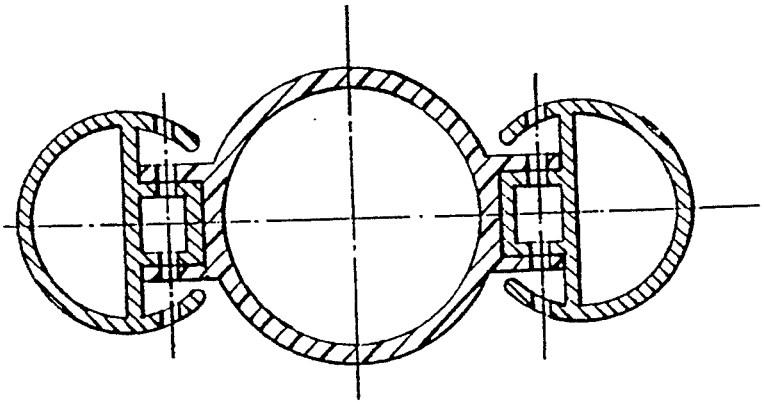
FIG. 14A is a cross-sectional view according to FIG. 4.

Please now refer to FIGS. 14 and 14A which show a third embodiment of the lateral tubes of the present invention, wherein each lateral tube 11 is similar to the lateral tube 21 of the first embodiment except that the lateral tube 11 further has a pair of arch sections 112 further extending inward through a predetermined length from two ends of the outer semi-circular tube section. The arch sections 112 are formed with through holes 113 for passing a rivet therethrough.

When assembled, the supporting tube 4 is fitted with two lower ends of the lateral tubes 11 and slided upward therefrom to a predetermined portion of the lateral tubes 11. Then the bottom cap 5 is fitted with the bottom end of the engaged supporting tube 8 and lateral tubes 9. Then a rivet can be extended through the through holes 113 of the arch sections 112 and the corresponding through holes of the C-shaped rib section 42 of the supporting tube 4 and the rectangular beam section 111 of the lateral tube 11 to secure the supporting tube 4 with the lateral tube 11.

The above embodiment is only an example of the present invention and the scope of the present invention should not be limited to the example. Any modification or variation derived from the example should fall within the scope of the present invention.

What is claimed is:

1. A crutch structure comprising an armpit seat, a lateral tube assembly having two lateral tubes, a handle assembly, a middle supporting tube, a bottom cap and a telescopic tube, wherein:

said armpit seat having two sleeve sections said lateral tubes are symmetrically arranged, each including an outer semi-circular tube section and an inner rectangular beam section, multiple aligned pairs of transverse through holes being formed on predetermined portions of said lateral tubes, lower portions of said lateral tubes first extending downward and toward each other and then extending straight downward in parallel with each other;

said handle assembly is substantially H-shaped, including two vertically arranged sleeve members formed with transverse through holes, and a transverse handle member formed with a transverse central through hole corresponding to said transverse through holes of said sleeve members, said sleeve members being fitted on said lateral tubes in alignment with one of said pairs of through holes thereof and said handle being transversely disposed between said sleeve members, whereby an elongated thread rod is extended through said through holes of said lateral tubes, said thread holes of said sleeve members and said central through hole of said handle to engage with a butterfly nut to lock said handle assembly on said lateral tubes a telescopic tube having a V-shaped resilient member, said resilient member having free ends and projecting bosses on said free ends; and said middle supporting tube includes a central circular tube section having multiple aligned pairs of circular through holes formed on front and back sides of said circular tube section, and two lateral substantially C-shaped outward open rib sections, whereby said crutch structure is assembled in such a manner that said sleeve members of said handle assembly are first fitted on said lateral tubes and then two upper ends of said lateral tubes are inserted into two sleeve sections of said armpit seat and riveted therewith, and then said C-shaped rib sections of said middle supporting tube are engaged with said rectangular beam sections of said lateral tubes and slided upward from bottom ends thereof to a predetermined position, and then said C-shaped rib sections are secured with said rectangular beam sections by rivets and then said bottom cap is fitted with and riveted with bottom end of the engaged lateral tubes and middle supporting tube, and then said telescopic tube is fitted into said middle supporting tube with bosses of a V-shaped resilient member compressed and inserted into a desired one of said pairs of through holes of said middle supporting tube so as to lock said telescopic tube in said middle supporting tube and finally, said handle is adjustably secured between said sleeve members and said handle assembly is locked with said lateral tubes at a height according to the length of a user' hand.

2. A crutch structure as claimed in claim 1, wherein each said lateral tube further has a pair of arch sections further extending inward through a predetermined length from two ends of said outer semi-circular tube section of said lateral tube, said arch sections being formed with through holes for passing a rivet therethrough.

3. A crutch structure comprising an armpit seat, a lateral tube assembly having two lateral tubes, a handle assembly, a middle supporting tube, a bottom cap and a telescopic tube, wherein the armpit seat has two sleeve sections;

said lateral tubes are symmetrically arranged, each including an outer semi-circular tube section and an inner rectangular beam section, multiple aligned pairs of transverse through holes being formed on predetermined portions of said lateral tubes, lower portions of said lateral tubes first extending downward and toward each other and then extending straight downward in parallel with each other;

said handle assembly is an integrally molded H-shaped member including two longitudinal tube sections and a transverse tube section, a transverse central through hole being disposed through said transverse tube section and said longitudinal tube sections, said through hole being fitted on said lateral tubes in alignment with one of said pairs of through holes thereof and said handle being transversely disposed between said sleeve members, whereby an elongated thread rod is extended through said through holes of said lateral tubes for engagement with a butterfly nut to lock said handle on said lateral tubes; and said middle supporting tube includes a central circular tube section having multiple aligned paris of circular through holes formed on front and back sides of said circular tube section, and two lateral substantially C-shaped outward open rib sections, a telescopic tube having a V-shaped resilient member, said resilient member having free ends and projecting bosses on the free ends;

whereby said crutch structure is assembled in such a manner that said sleeve members of said handle assembly are first fitted on said lateral tubes and then two upper ends of said lateral tubes are inserted into two sleeve sections of said armpit seat and riveted therewith, and then said C-shaped rib sections of said middle supporting tube are engaged with said rectangular beam sections of said lateral tubes and slided upward from bottom ends thereof to a predetermined position, and then said C-shaped rib sections are secured with said rectangular beam sections by rivets and then said bottom cap is fitted with and riveted with bottom end of the engaged lateral tubes and middle supporting tube, and then said telescopic tube is fitted into said middle supporting tube with bosses of a V-shaped resilient member compressed and inserted into a desired one of said pairs of through holes of said middle supporting tube so as to lock said telescopic tube in said middle supporting tube and finally, said handle is adjustably secured between said sleeve members and said handle assembly is locked with said lateral tubes at a height according to the length of a user's hand.

4. A crutch structure comprising an armpit seat, a lateral tube assembly having two lateral tubes, a handle assembly, a middle supporting tube, a bottom cap and a telescopic tube, wherein the armpit seat has two sleeve sections;

said lateral tubes are symmetrically arranged, each including an outer semi-circular tube section and an inner semi-circular section with a diameter smaller than that of said outer semi-circular section, multiple aligned pairs of transverse through holes being formed on predetermined portions of said lateral tubes, lower portions of said lateral tubes first extending downward and toward each other and then extending straight downward in parallel with each other;

said handle assembly is substantially H-shaped, including two vertically arranged sleeve members formed with transverse through holes, and a transverse handle member formed with a transverse central through hole corresponding to said transverse through holes of said sleeve members, said sleeve members being fitted on said lateral tubes in alignment with one of said pairs of through holes thereof and said handle being transversely disposed between said sleeve members, whereby an elongated thread rod is extended through said through holes of said lateral tubes, said thread holes of said sleeve members an said central through hole of said handle to engage with a butterfly nut to lock said handle assembly on said lateral tubes; and said middle supporting tube includes a central circular tube section having multiple aligned pairs of circular through holes formed on front and back sides of said circular tube section, and two lateral concave semi-circular ribs sections corresponding to said inner semi-circular section of said lateral tubes, a telescopic tube having a V-shaped resilient member, said resilient member having free ends and projecting bosses on the free ends;

whereby said crutch structure is assembled in such a manner that said sleeve members of said handle assembly are first fitted on said lateral tubes and then two upper ends of said lateral tubes are inserted into two sleeve sections of said armpit seat and riveted therewith, and then said C-shaped rib sections of said middle supporting tube are engaged with said inner semi-circular sections of said lateral tubes and slided upward from bottom ends thereof to a predetermined position, and then said C-shaped rib sections are secured with said inner semi-circular sections by rivets and then said bottom cap is fitted with and riveted with bottom end of the engaged lateral tubes and middle supporting tube, and then said telescopic tube is fitted into said middle supporting tube with bosses of a V-shaped resilient member compressed and inserted into a desired one of said pairs of through holes of said middle supporting tube so as to lock said telescopic tube in said supporting tube and finally, said handle is adjustably secured between said sleeve members and said handle assembly is locked with said lateral tubes at a height according to the length of a user's hand.

* * * * *